US007522869B2

(12) United States Patent
Anderson et al.

(10) Patent No.: US 7,522,869 B2
(45) Date of Patent: Apr. 21, 2009

(54) INLINE WAX COATING PROCESS FOR XEROGRAPHICALLY PREPARED MICR CHECKS

(75) Inventors: Christine Anderson, Hamilton (CA); T Brian McAneney, Burlington (CA); Kurt I. Halfyard, Mississauga (CA); Edward G. Zwartz, Mississauga (CA); Gordon Sisler, St. Catharines (CA)

(73) Assignee: Xerox Corporation, Norwalk, CT (US)

( * ) Notice: Subject to any disclaimer, the term of this patent is extended or adjusted under 35 U.S.C. 154(b) by 117 days.

(21) Appl. No.: 11/523,283

(22) Filed: Sep. 18, 2006

(65) Prior Publication Data

US 2008/0075507 A1 Mar. 27, 2008

(51) Int. Cl.
*G03G 15/16* (2006.01)

(52) U.S. Cl. ..... 399/297

(58) Field of Classification Search ..... 399/297
See application file for complete search history.

(56) References Cited

U.S. PATENT DOCUMENTS 3,434,993 A * 3/1969 Rabel et al. ..... 524/586
4,231,593 A 11/1980 Bell, Jr. et al.
4,901,114 A * 2/1990 Parker et al. ..... 399/232
6,830,819 B2 * 12/2004 Kaplan et al. ..... 428/447
2002/0051658 A1 * 5/2002 Nagaoka et al. ..... 399/299

* cited by examiner

*Primary Examiner*—David M Gray
*Assistant Examiner*—Andrew V Do
(74) *Attorney, Agent, or Firm*—Annette L. Bade

(57) ABSTRACT

A process of MICR and non-MICR electrostatic magnetic imaging of two independent electrostatic latent images including forming a first electrostatic latent image in a MICR printing apparatus; developing the first electrostatic latent image by contacting the first electrostatic latent image with a MICR toner to produce a developed MICR toner image; transferring the developed MICR toner image onto a check; forming a second electrostatic latent image in a non-MICR printing apparatus; developing the second electrostatic latent image by contacting the second electrostatic latent image with a non-MICR toner to produce a developed non-MICR image; transferring the developed non-MICR toner image to the check; and fusing the developed MICR toner image and the developed non-MICR toner image to the check.

24 Claims, 3 Drawing Sheets

INLINE WAX COATING PROCESS FOR XEROGRAPHICALLY PREPARED MICR CHECKS

BACKGROUND

Herein are described processes and formulations for coating checks to be used in many applications including printing, for example, electrophotographic, ionographic or magnetographic prints, such as in xerographic printers and copiers, especially MICR (magnetic ink character recognition) and related processes, including digital systems. In embodiments, the coatings are wax-based coatings, using waxes such as polyethylene waxes.

Demand for color and personalization of checks has been growing. Some current xerographic machines used to print checks have limitations, including the inability to use MICR toner and residual fuser oil present on the fused checks. Residual fuser oil (for example, amino-functional polydimethylsiloxane (PDMS) fuser oil) on the checks leads to problems with secondary MICR imprinting (when the amount field is subsequently imprinted on the check at a bank, for example). It is believed that the residual fuser oil on the checks leads to a decrease in ink receptivity, which, in turn, results in poor secondary MICR imprinting; this leads to a reader reject rate of approximately 30% or more. Current solutions to the problem include manual cleaning of the checks with organic solvents.

U.S. Pat. No. 4,231,593 discloses a check with first and second coatings, one of which is electrically conductive, and the other which is electrically non-conductive.

It is desired to provide a process for allowing successful secondary MICR imprinting of checks, after the initial MICR/color fusing. Herein is disclosed processes and coatings for MICR color printed checks, wherein the coating is applied either before any imaging and fusing (i.e., a blank check) or later, for example, from about 50 milliseconds to about 120 seconds after the final fusing process (but in embodiments, before the secondary encoding) using an in-line coater, in embodiments. The coating, in effect, repels and seals in the fuser oil, and therefore, leaves a surface on which further MICR imprinting can be successfully achieved. It is believed that the wax is compatible with the wax used in the secondary encoding ribbon, which encourages complete transfer of the MICR characters from the ribbon to the coated check. In embodiments, the secondary MICR imprinting can be carried out with a reader rejection rate, which is, in embodiments, greatly improved over uncoated, oil-covered checks.

SUMMARY

Embodiments include a process of MICR and non-MICR electrostatic magnetic imaging of two independent electrostatic latent images comprising (a) optionally pre-treating a blank check with a wax-based coating comprising an aqueous polyethylene wax emulsion (b) forming a first electrostatic latent image in a MICR printing apparatus; (c) developing the first electrostatic latent image by contacting the first electrostatic latent image with a MICR toner to produce a developed MICR toner image; (d) transferring and optionally fusing the developed MICR toner image onto a check (e) forming a second electrostatic latent image in a non-MICR printing apparatus; (f) developing the second electrostatic latent image by contacting the second electrostatic latent image with a non-MICR toner to produce a developed non-MICR image; (g) transferring the developed non-MICR toner image to the check; (h) fusing the developed MICR toner image and the developed non-MICR toner image to the check, wherein a fuser oil is supplied to the check during fusing; (i) optionally coating the check having fused developed MICR toner image and fused developed non-MICR toner image with a wax-based coating comprising an aqueous polyethylene wax emulsion, and wherein (a) and (i) are mutually exclusive.

Embodiments also include a process of MICR and non-MICR electrostatic magnetic imaging of two independent electrostatic latent images comprising (a) optionally pre-treating a blank check with a wax based coating comprising an aqueous polyethylene wax emulsion (b) forming a first electrostatic latent image in a MICR printing apparatus; (c) developing the first electrostatic latent image by contacting the first electrostatic latent image with a MICR toner to produce a developed MICR toner image; (d) transferring and optionally fusing the developed MICR toner image onto a check; (e) forming a second electrostatic latent image in a non-MICR printing apparatus; (f) developing the second electrostatic latent image by contacting the second electrostatic latent image with a non-MICR toner to produce a developed non-MICR image; (g) transferring the developed non-MICR toner image to the check; (h) fusing the developed MICR toner image and the developed non-MICR toner image to the check, wherein a fuser oil is supplied to the check during fusing, and wherein the fuser oil is selected from the group consisting of non-functional polydimethylsiloxane fuser oil, amino functional polydimethylsiloxane fuser oil, mercapto functional polydimethylsiloxane fuser oil, and mixtures thereof; (i) optionally coating the check having fused developed MICR toner image and fused developed non-MICR toner image with a wax-based coating comprising an aqueous polyethylene wax emulsion, and wherein (a) and (i) are mutually exclusive.

In addition, embodiments include a process of MICR and non-MICR electrostatic magnetic imaging of two independent electrostatic latent images comprising (a) optionally pre-treating a blank check with a wax based coating comprising an aqueous polyethylene wax emulsion, a surfactant and a viscosity modifier (b) forming a first electrostatic latent image in a MICR printing apparatus; (c) developing the first electrostatic latent image by contacting the first electrostatic latent image with a MICR toner to produce a developed MICR toner image; (d) transferring and optionally fusing the developed MICR toner image onto a check; (e) forming a second electrostatic latent image in a non-MICR printing apparatus; (f) developing the second electrostatic latent image by contacting the second electrostatic latent image with a non-MICR toner to produce a developed non-MICR image; (g) transferring the developed non-MICR toner image to the check; (h) fusing the developed MICR toner image and the developed non-MICR toner image to the check, wherein a fuser oil is supplied to the check during fusing; (i) optionally coating the check having fused developed MICR toner image and fused developed non-MICR toner image with a wax-based coating comprising an aqueous polyethylene wax emulsion, and wherein (a) and (i) are mutually exclusive.

BRIEF DESCRIPTION OF THE DRAWINGS

Reference may be had to the accompanying drawings, which include.

DETAILED DESCRIPTION

Herein are described electrostatic processes for generating documents suitable for magnetic image character recognition (MICR) involving the use of magnetic toner compositions. In embodiments, documents such as checks and personal checks can be prepared and printed. Herein are described coating formulations and processes for coating checks preceding or following the initial MICR and non-MICR imaging and fusing of the check while mitigating the negative effects of fuser oil, thereby increasing reader reliability.

Xerox DocuTech® and other machines can be used to print checks, and in embodiments, MICR encoding checks. The process allows for basic check writing abilities, but does not provide the flexibility to use color or allow for personalization of checks. In some machines, such as the DocuTech® family of machines, the background and initial MICR encoding is all performed on one machine. Fuser oils such mercapto, amino and other functional PDMS fuser oils, non-functional PDMS oils, and mixtures thereof, are used in such machines. The fuser oils are used to strip the sheets from the fuser members. Further, secondary MICR encoding is performed at the "bank of first deposit" where the MICR imprinting is placed over the fused check. When the completed check is placed through the check reader/sorter, the reject rate must be at or below 0.5%.

With processes incorporating full color printing and MICR capabilities, the major problem which arises is the fact that the read rate of the checks printed on such machines is around a 30% failure rate. This is thought to be due to the difference in fuser oil employed in known color machines. For example, amino functional PDMS oil is used as opposed to mercapto functional PDMS oil. This amino functional oil interferes with ink receptivity, and therefore secondary MICR imprinting, thus leading to the high rejection rates. In order to provide full color printing and MICR capabilities, it is desired to develop a process to mitigate the oil problem.

The application of a wax overcoat 6 to an oil covered check 1 functions in a two-fold manner; if applied after fusing it forms a relatively continuous film of wax over the release oil, thus sealing in the oil. However, if applied before any imaging & fusing it may act as an oil repellent and cause the oil to seep into the coating cracks, thereby offering a surface relatively free of oil. Secondly, the wax is compatible with the wax used in the secondary encoding ribbon, thereby encouraging complete transfer of the imprinted figures from the ribbon to the check. These wax coatings can be used on both coated and uncoated paper on a wide range of paper stock.

Typical fuser oils that can be used include non-functional and functional PDMS fuser oils, such as functional amino PDMS, functional mercapto PDMS, and mixtures thereof. The oil rate per copy ranges from about 1 to about 20 microliters per copy.

Figure 1:
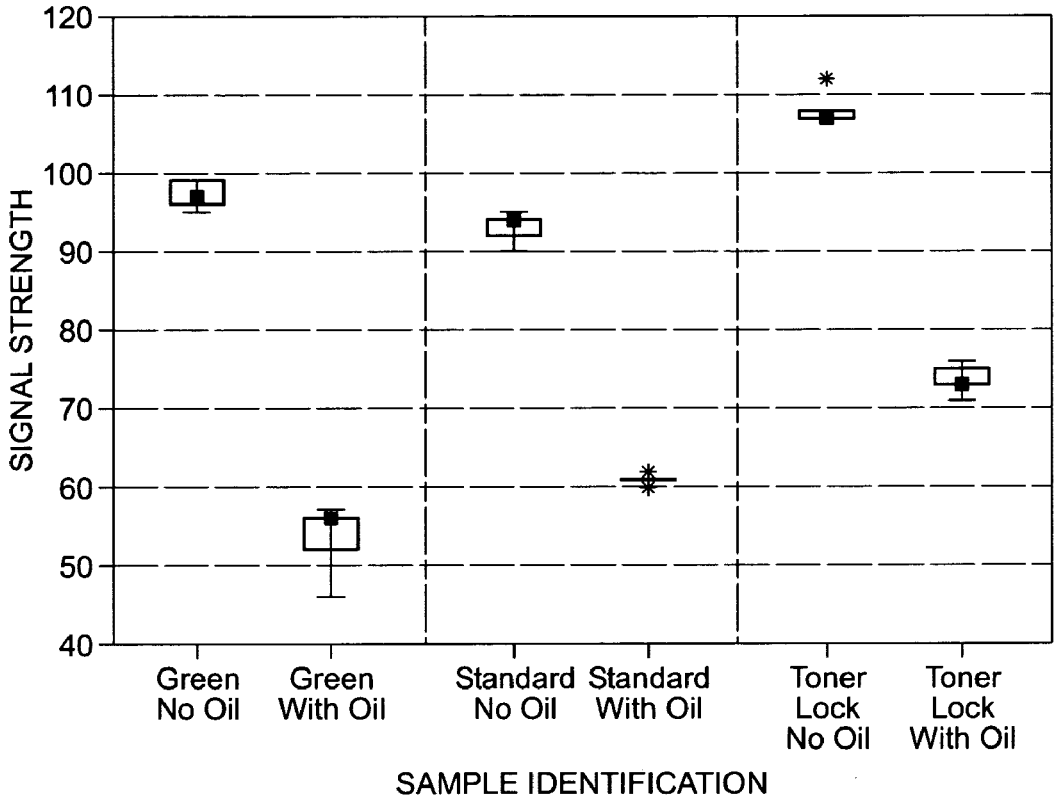
FIG. 1 is a box plot of signal strength and shows the relative signal strengths of three different check types when there is no oil present on the checks, and when there is oil present on the checks.
Figure 2:
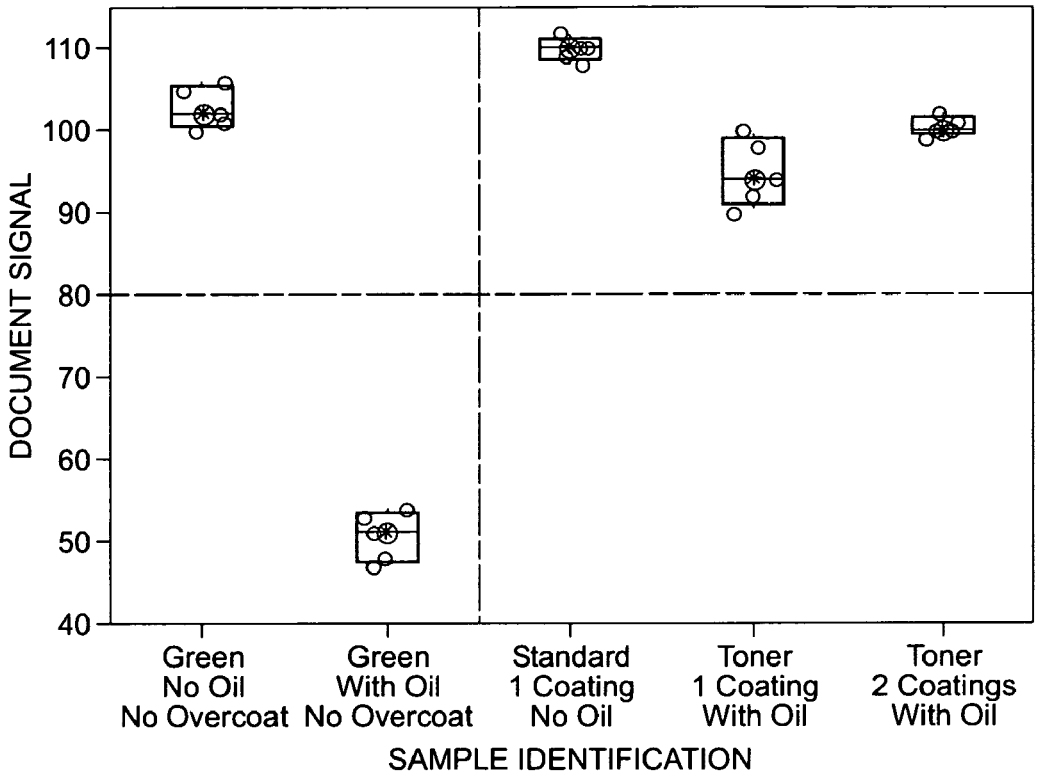
FIG. 2 is a box plot of signal strength and shows the signal strength for a check coated with a polyethylene wax.
Figure 3:
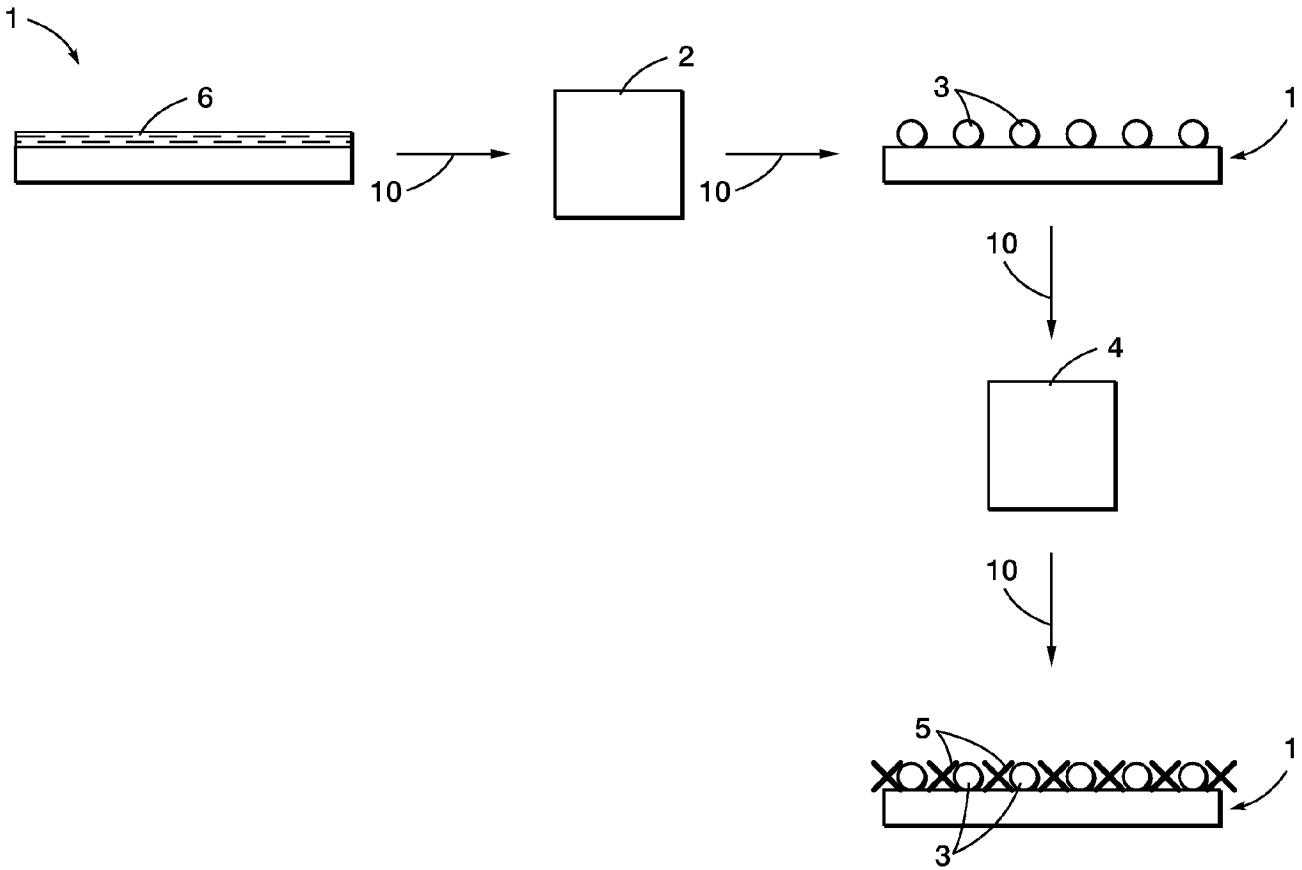
FIG. 3 is a general illustration of the process, in embodiments.

The process may be used with a monochrome xerographic printer 2 and in particular, a high-speed xerographic printer, using MICR toner 3 followed by a high-speed xerographic printing machine 4 using non-MICR toner 5. The MICR toner is black, in embodiments, and the non-MICR xerographic toner can be black or color, and in embodiments, is color. The xerographic MICR printer 2 and non-MICR xerographic print engine 4 may be separate machines, which are either loosely or tightly coupled. FIG. 3 demonstrates an embodiment of the process outlined herein, as the check 1 moves in the direction of arrows 10.

In embodiments, a first toner (a MICR toner) is used to develop an initial latent image on a check in a MICR printing apparatus. The first toner can comprise a resin, wax, colorant, and optional additives.

The MICR toner compositions selected herein may comprise resin particles, magnetites, and optional colorant, such as pigment, dyes, carbon blacks, and waxes such as polyethylene and polypropylene. The toners can further include a second resin, a colorant or colorants, a charge additive, a flow additive, reuse or recycled toner fines, and other ingredients. Also there can be blended at least one surface additive with the ground and classified melt mixed toner product. Toner particles in embodiments can have a volume average diameter particle size of about 6 to about 25, or from about 6 to about 14 microns.

Resin

Illustrative examples of resins suitable for MICR toner and MICR developer compositions herein include linear or branched styrene acrylates, styrene methacrylates, styrene butadienes, vinyl resins, including linear or branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. A specific example includes styrene butadiene copolymers, mixtures thereof, and the like, and also styrene/n-butyl acrylate copolymers, PLIOLITES®; suspension polymerized styrene butadienes, reference U.S. Pat. No. 4,558,108, the disclosure of which is totally incorporated herein by reference.

Magnetite

Various forms of iron oxide can be used as the magnetite. Magnetites can include a mixture of iron oxides (for example, $FeO.Fe_2O_3$) and carbon black, including those commercially available as MAPICO BLACK®. Mixtures of magnetites can be present in the toner composition in an amount of from about 10 to about 70 percent by weight, or from about 10 percent by weight to about 50 percent by weight. Mixtures of carbon black and magnetite with from about 1 to about 15 weight percent of carbon black, or from about 2 to about 6 weight percent of carbon black, and magnetite, in an amount of, for example, from about 5 to about 60, or from about 10 to about 50 weight percent, can be selected.

Wax

Illustrative examples of aliphatic hydrocarbon waxes include low molecular weight polyethylene and polypropylene waxes with a weight average molecular weight of, for example, about 500 to about 5,000. Also, there are included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes used for the toner compositions are believed to have a molecular weight of from about 4,000 to about 5,000. The wax can be present in the toner in an amount of from about 4 to about 7 weight percent.

Optional Carrier

Illustrative examples of carrier particles include iron powder, steel, nickel, iron, ferrites, including copper zinc ferrites, and the like. The carrier can be coated with a costing such as terpolymers of styrene, methylmethacrylate, and a silane, such as triethoxy silane, including for example KYNAR® and polymethylmethacrylate mixtures (40/60). Coating weights can vary as indicated herein. However, the weights can be from about 0.3 to about 2, or from about 0.5 to about 1.5 weight percent coating weight.

The present process can be employed with either or both single component (SCD) and two-component development systems. Toners useful in MICR printing include mono-component and dual-component toners. Toners for MICR include those having a binder and at least one magnetic material. Optionally, the toner may include a surface treatment such as a charge control agent, or flowability improving agents, a release agent such as a wax, colorants and other additives.

Suitable non-MICR toners are disclosed in, for example, U.S. Pat. Nos. 6,326,119; 6,365,316; 6,824,942 and 6,850,725, the disclosures thereof are hereby incorporated by reference in their entirety. In embodiments, the non-MICR toner can be black or color, and in embodiments, is color non-MICR xerographic toner.

Resin

The non-MICR toner resin can be a partially crosslinked unsaturated resin such as unsaturated polyester prepared by crosslinking a linear unsaturated resin (hereinafter called base resin), such as linear unsaturated polyester resin, in embodiments, with a chemical initiator, in a melt mixing device such as, for example, an extruder at high temperature (e.g., above the melting temperature of the resin, and more specifically, up to about 150° C. above that melting temperature) and under high shear. Also, the toner resin possesses, for example, a weight fraction of the microgel (gel content) in the resin mixture of from about 0.001 to about 50 weight percent, from about 1 to about 20 weight percent, or about 1 to about 10 weight percent, or from about 2 to about 9 weight percent. The linear portion is comprised of base resin, more specifically unsaturated polyester, in the range of from about 50 to about 99.999 percent by weight of the toner resin, or from about 80 to about 98 percent by weight of the toner resin. The linear portion of the resin may comprise low molecular weight reactive base resin that did not crosslink during the crosslinking reaction, more specifically unsaturated polyester resin.

The molecular weight distribution of the resin is thus bimodal having different ranges for the linear and the crosslinked portions of the binder. The number average molecular weight ($M_n$) of the linear portion as measured by gel permeation chromatography (GPC) is from, for example, about 1,000 to about 20,000, or from about 3,000 to about 8,000. The weight average molecular weight ($M_w$) of the linear portion is from, for example, about 2,000 to about 40,000, or from about 5,000 to about 20,000. The weight average molecular weight of the gel portions is greater than 1,000,000. The molecular weight distribution ($M_w/M_n$) of the linear portion is from about 1.5 to about 6, or from about 1.8 to about 4. The onset glass transition temperature (Tg) of the linear portion as measured by differential scanning calorimetry (DSC) is from about 50° C. to about 70° C.

Moreover, the binder resin, especially the crosslinked polyesters, can provide a low melt toner with a minimum fix temperature of from about 100° C. to about 200° C., or from about 100° C. to about 160° C., or from about 110° C. to about 140° C.; provide the low melt toner with a wide fusing latitude to minimize or prevent offset of the toner onto the fuser roll; and maintain high toner pulverization efficiencies. The toner resins and thus toners, show minimized or substantially no vinyl or document offset.

Examples of unsaturated polyester base resins are prepared from diacids and/or anhydrides such as, for example, maleic anhydride, fumaric acid, and the like, and mixtures thereof, and diols such as, for example, propoxylated bisphenol A, propylene glycol, and the like, and mixtures thereof. An example of a suitable polyester is poly(propoxylated bisphenol A fumarate).

In embodiments, the toner binder resin is generated by the melt extrusion of (a) linear propoxylated bisphenol A fumarate resin, and (b) crosslinked by reactive extrusion of the linear resin with the resulting extrudate comprising a resin with an overall gel content of from about 2 to about 9 weight percent. Linear propoxylated bisphenol A fumarate resin is available under the trade name SPAR II™ from Resana S/A Industrias Quimicas, Sao Paulo Brazil, or as NEOXYL P2294™ or P2297™ from DSM Polymer, Geleen, The Netherlands, for example. For suitable toner storage and prevention of vinyl and document offset, the polyester resin blend more specifically has a Tg range of from, for example, about 52° C. to about 64° C.

Chemical initiators, such as, for example, organic peroxides or azo-compounds, can be used for the preparation of the crosslinked toner resins.

The low melt toners and toner resins may be prepared by a reactive melt mixing process wherein reactive resins are partially crosslinked. For example, low melt toner resins may be fabricated by a reactive melt mixing process comprising (1) melting reactive base resin, thereby forming a polymer melt, in a melt mixing device; (2) initiating crosslinking of the polymer melt, more specifically with a chemical crosslinking initiator and increased reaction temperature; (3) retaining the polymer melt in the melt mixing device for a sufficient residence time that partial crosslinking of the base resin may be achieved; (4) providing sufficiently high shear during the crosslinking reaction to keep the gel particles formed and broken down during shearing and mixing, and well distributed in the polymer melt; (5) optionally devolatilizing the polymer melt to remove any effluent volatiles; and (6) optionally adding additional linear base resin after the crosslinking in order to achieve the desired level of gel content in the end resin. The high temperature reactive melt mixing process allows for very fast crosslinking which enables the production of substantially only microgel particles, and the high shear of the process prevents undue growth of the microgels and enables the microgel particles to be uniformly distributed in the resin.

A reactive melt mixing process is, for example, a process wherein chemical reactions can be affected on the polymer in the melt phase in a melt-mixing device, such as an extruder. In preparing the toner resins, these reactions are used to modify the chemical structure and the molecular weight, and thus the melt rheology and fusing properties of the polymer. Reactive melt mixing is particularly efficient for highly viscous materials, and is advantageous because it requires no solvents, and thus is easily environmentally controlled. As the amount of crosslinking desired is achieved, the reaction products can be quickly removed from the reaction chamber.

The resin is present in the non-MICR toner in an amount of from about 40 to about 98 percent by weight, or from about 70 to about 98 percent by weight. The resin can be melt blended or mixed with a colorant, charge carrier additives, surfactants, emulsifiers, pigment dispersants, flow additives, embrittling agents, and the like. The resultant product can then be pulverized by known methods, such as milling, to form the desired toner particles.

Waxes

Waxes with, for example, a low molecular weight $M_w$ of from about 1,000 to about 10,000, such as polyethylene, polypropylene, and paraffin waxes, can be included in, or on the toner compositions as, for example, fusing release agents.

Colorants

Various suitable colorants of any color can be present in the non-MICR toners, including suitable colored pigments, dyes, and mixtures thereof including REGAL 330®; (Cabot), Acetylene Black, Lamp Black, Aniline Black; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like; cyan, magenta, yellow, red, green, brown, blue or mixtures thereof, such as specific phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments and dyes that can be selected are cyan, magenta, or yellow pigments or dyes, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Other colorants are magenta colorants of (Pigment Red) PR81:2, CI 45160:3. Illustrative examples of cyans that may be selected include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Forum Yellow SE/GLN, CI Dispersed Yellow 33 2,5-dimethoxy-4-sulfonanilide phenylazo-4'-chloro-2,5-dimethoxy acetoacetanilides, and Permanent Yellow FGL, PY17, CI 21105, and known suitable dyes, such as red, blue, green, Pigment Blue 15:3 C.I. 74160, Pigment Red 81:3 C.I. 45160:3, and Pigment Yellow 17 C.I. 21105, and the like, reference for example U.S. Pat. No. 5,556,727, the disclosure of which is totally incorporated herein by reference.

The colorant, more specifically black, cyan, magenta and/or yellow colorant, is incorporated in an amount sufficient to impart the desired color to the toner. In general, pigment or dye is selected, for example, in an amount of from about 2 to about 60 percent by weight, or from about 2 to about 9 percent by weight for color toner, and about 3 to about 60 percent by weight for black toner.

The non-MICR toner composition can be prepared by a number of known methods including melt blending the toner resin particles, and pigment particles or colorants, followed by mechanical attrition. Other methods include those well known in the art such as spray drying, melt dispersion, dispersion polymerization, suspension polymerization, extrusion, and emulsion/aggregation processes.

The resulting non-MICR toner particles can then be formulated into a developer composition. The toner particles can be mixed with carrier particles to achieve a two-component developer composition.

In embodiments, a wax based coating can be applied either before or after the initial MICR and non-MICR printing step and fusing step, but before any secondary MICR imprinting has taken place. It is believed that the wax masks and repels the fuser oil, which is left on the surface of the check after printing. It is further believed that the polyethylene wax on the surface of the check from coating is compatible with the thermal transfer ribbon used during the secondary MICR encoding (which also contains a wax in the binder). When the wax is placed on the surface of a check prepared by the processes described herein, the increase in signal strength is comparable to that of an un-oiled check.

In embodiments, the coating may be applied on a blank check as a pretreatment (before any imaging or fusing) or may be applied at a time of from about 50 milliseconds to about 120 seconds, or from about 1 second to about 100 seconds after the MICR and non-MICR printing and fusing steps, but before any secondary MICR imprinting. Drying can be accomplished by use of ambient air and minimal heat, for example, heating to from about 1 to about 90° C., or from about 25 to about 45° C., or from about 30 to about 38° C.

Suitable check coatings herein include wax based coatings. The wax coatings can comprise aqueous polyethylene wax emulsions. In embodiments, the polyethylene wax has a melting point of from about 100 to about 150° C., or from about 125 to about 135° C. In embodiments, the aqueous polyethylene wax emulsion has a viscosity of from about 1 to about 100 centipoise, or from about 5 to about 50 centipoise, or from about 10 to about 20 centipoise. In embodiments, the aqueous polyethylene wax emulsion has a pH of from about 9.0 to about 10.5, or from about 9.2 to about 9.8, or about 9.6. In embodiments, the aqueous polyethylene wax emulsion has a solids content of from about 20 to about 40, or from about 26 to about 34 percent by weight. Particle size of the polyethylene wax may range from 0.05 to 0.1 micron. The water content of the aqueous polyethylene emulsion may range from 66 to 74%.

Specific examples of suitable waxes include polyethylene waxes such as JONWAX 26 (polyethylene wax from Johnson Polymer/BASF and having a melting point of about 130° C., particle size of from about 50 to about 100 nm, a loading of about 26 percent solids, a density of about 8.2 lbs/gal, a viscosity of about 10 centipoise, and a pH of about 9.8. The wax is a light translucent emulsion in water) and Jonwax 28 (polyethylene wax from Johnson Polymer/BASF and having a melting point of about 132° C., particle size of from about 80 to about 100 nm, a loading of about 34 percent solids, a density of about 8.3 lbs/gal, a viscosity of about 50 centipoise, and a pH of about 9.2).

The wax is present in the coating in an amount of from about 30 to about 60 percent, or from about 34 to about 56 percent by weight.

Other ingredients of the wax coating, in addition to the aqueous polyethylene wax emulsion, include surfactants. Suitable surfactants include Surfynol 504 (from Air Products), which includes a mixture of butanedioic acid, 1,4-bis (2-ethylhexyl)ester, sodium salt; NOVEC FC4432 (from 3M), which includes perfluorobutane sulfonates; and the like surfactants, and mixtures thereof. The surfactant is present in the wax coating in an amount of from about 0.1 to about 5 percent, or from about 0.5 to about 1 percent by weight. A surfactant is a surface-active agent that accumulates at the interface between 2 liquids and modifies their surface properties.

Other ingredients include water, which is present in the coating formulation from 55 to 75 percent by weight. Viscosity modifiers may also be present and include those which are alkali swellable, such as Acrysol ASE-60 (from Rohm & Haas), and associative thickeners such as Rheolate 255 (available from Elementis), and mixtures thereof.

The wax coating has a surface tension of from about 10 to about 50, or from about 22 to about 34 mN/meter. This surface tension may be adjusted to closely match that of the fuser oil (about 22 mN/m) to ensure complete wetting of the check.

The coating can be applied to the blank or developed and fused check by known methods including roll coaters, offset gravure, gravure and reverse roll coating. In embodiments, the developed and fused check is coated on a two or three roll coating system, such as an Euclid Coating System lab coater (available from Euclid Coating Systems). The coating can be accomplished at a speed of from about 10 to about 100, or from about 30 to about 40 meters per minute. The coating can be applied to a thickness of from about 1 to about 10, or from about 1 to about 5 microns wet, or from about 0.5 to about 5, or from about 1.5 to about 2 microns dry. The check can then be dried using known methods including air drying, ultraviolet drying, heat drying, and the like. In embodiments, the coated check is placed on a belt of an Fusion UV System at a speed of from about 50 to about 200, or from about 75 to about 100 feet per minute, and allowed to dry under the heat generated by the UV lamp (heated at from about 10 to about 50, or from about 30 to about 50° C.). The coating provides sufficient wetting to allow for a uniform coating over oil covered, fused toner checks.

After the coating is placed on the check and dried secondary MICR imprinting may take place. Any known encoder can be used to supply the MICR encoding. For example, an NCR 7766-1000 encoder, available from NCR Corporation, using magnetic thermal transfer ribbon, which places the ink from the ribbon onto the dried coating.

The following Examples are intended to illustrate and not limit the scope herein. Parts and percentages are by weight unless otherwise indicated.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

EXAMPLES

Example 1

Preparation of Coating Formulation

Check stock can be purchased from Xerox Corporation. The check stock was run through a Xerox fusing system to coat the paper stock with a representative amount of oil, such as about 10-12 microlitres of oil per copy. The check stock was then treated with an aqueous wax coating comprising the following:

| Component | Amount (Percent by Weight) |
|---|---|
| Jonwax 26 | 35-55 |
| Water | 6075 |
| Surfynol 504/FC4432 (90/10 mixture) | 0.75 |
| Acrsyol ASE-60 or Elementis 255 | 2.5 |

The check was then attached to a lead sheet and fed through the Euclid Coating System lab coater at a speed of 30 meters/minute. The coated check was then placed on the belt of a Fusion UV Systems at a speed of approximately 100 feet/minute and allowed to dry under the heat generated by the UV lamp (38 Celsius).

Example 2

Secondary Encoding

Once the paper and wax emulsion were dried, the secondary encoding took place. This was accomplished using an NCR 7766-1000 encoder having a magnetic thermal transfer ribbon (MTTR), which places the ink (secondary encoding) on the dried wax.

Example 3

Testing

Subsequently, the completely finished check was tested by measuring the magnetic signal strength of the encoding. The check was run through a GTX Qualifier. A check which does not contain any oil (amino or otherwise) will produce a signal strength of approximately 98%±2%. However, when covered with a 0.09% amino functionalized fuser oil, the signal strength decreases to approximately 56%±2%. The current standard, which indicates a potentially acceptable solution is a signal strength of greater than about 95%. When the above printing, fusing, coating and encoding were carried out using the stated wax emulsion coating, the magnetic signal strength was measured to be approximately 98% (essentially the same as a blank check with no fuser oil).

It will be appreciated that variants of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process of MICR and non-MICR electrostatic magnetic imaging of two independent electrostatic latent images comprising:

(a) pre-treating a blank check with a wax-based coating comprising an aqueous polyethylene wax emulsion;

(b) forming a first electrostatic latent image in a MICR printing apparatus;

(c) developing the first electrostatic latent image by contacting the first electrostatic latent image with a MICR toner to produce a developed MICR toner image;

(d) transferring and optionally fusing the developed MICR toner image onto a check;

(e) forming a second electrostatic latent image in a non-MICR printing apparatus;

(f) developing the second electrostatic latent image by contacting the second electrostatic latent image with a non-MICR toner to produce a developed non-MICR image;

(g) transferring said non-MICR toner image to said check;

(h) fusing said developed MICR toner image and said developed non-MICR toner image to the check, wherein a fuser oil is supplied to the check during fusing.

2. The process in accordance with claim 1, wherein said polyethylene wax has a melting point of from about 100 to about 150.degree. C.

3. The process in accordance with claim 2, wherein said polyethylene wax has a melting point of from about 125 to about 135.degree. C.

4. The process in accordance with claim 1, wherein said polyethylene wax emulsion has a solids percent by weight of from about 20 to about 40.

5. The process in accordance with claim 4, wherein said solids content is from about 26 to about 34 percent by weight.

6. The process in accordance with claim 1, wherein said polyethylene wax emulsion has a pH of from about 9.0 to about 10.5.

7. The process in accordance with claim 6, wherein said polyethylene wax emulsion has a pH of from about 9.2 to about 9.8.

8. The process in accordance with claim 1, wherein said polyethylene wax is present in said coating in an amount of from about 30 to about 60 percent by weight.

9. The process in accordance with claim 1, wherein after (i), the coating is dried to a dry thickness of from about 1 to about 5 microns.

10. The process in accordance with claim 1, wherein said wax coating further comprises a surfactant.

11. The process in accordance with claim 10, wherein said surfactant is a material selected from the group consisting of fluorosurfactants, butanedioic acid, sodium salt of 1,4-bis(2-ethylhexyl) ester, and mixtures thereof.

12. The process in accordance with claim 10, wherein said surfactant is present in the wax coating in an amount of from about 0.1 to about 5 percent by weight.

13. The process in accordance with claim 1, wherein said wax coating has a surface tension of from about 10 to about 50 mN/metre.

14. The process in accordance with claim 13, wherein said surface tension is from about 22 to about 34 mN/metre.

15. The process in accordance with claim 1, wherein said wax coating further comprises a viscosity modifier.

16. The process in accordance with claim 15, wherein said viscosity modifier is a material selected from the group consisting of alkali swellable viscosity modifiers, associative viscosity modifiers, and mixtures thereof.

17. The process in accordance with claim 1, wherein said non-MICR toner is a color toner.

18. The process in accordance with claim 1, wherein said fuser oil is selected from the group consisting of nonfunctional polydimethylsiloxane oils, mercapto functional polydimethylsiloxane fuser oils, amino functional polydimethylsiloxane fuser oils, and mixtures thereof.

19. The process in accordance with claim 1, wherein said coating is applied before any imaging and fusing as a pre-treatment.

20. The process in accordance with claim 1, wherein said coating is applied at a time of from about 50 milliseconds to about 120 seconds after the MICR and non-MICR fusing.

21. The process in accordance with claim 20, wherein said time is from about 1 second to about 100 seconds after the MICR and non-MICR fusing.

22. The process in accordance with claim 1, wherein said coating is applied using known methods of roll coaters, offset gravure, gravure or reverse roll coating.

23. A process of MICR and non-MICR electrostatic magnetic imaging of two independent electrostatic latent images comprising:

(a) optionally pre-treating a blank check with a wax based coating comprising an aqueous polyethylene wax emulsion;

(b) forming a first electrostatic latent image in a MICR printing apparatus;

(c) developing the first electrostatic latent image by contacting the first electrostatic latent image with a MICR toner to produce a developed MICR toner image;

(d) transferring and optionally fusing the developed MICR toner image onto a check;

(e) forming a second electrostatic latent image in a non-MICR printing apparatus;

(f) developing the second electrostatic latent image by contacting the second electrostatic latent image with a non-MICR toner to produce a developed non-MICR image;

(g) transferring said developed non-MICR toner image to said check;

(h) fusing said developed MICR toner image and said developed non-MICR toner image to the check, wherein a fuser oil is supplied to the check during fusing, and wherein said fuser oil is selected from the group consisting of nonfunctional polydimethylsiloxane fuser oils, amino functional polydimethylsiloxane fuser oils, mercapto functional polydimethylsiloxane fuser oils, and mixtures thereof;

(i) optionally coating the check having fused developed MICR toner image and fused developed non-MICR toner image with a wax-based coating comprising an aqueous polyethylene wax emulsion, and wherein (a) and (i) are mutually exclusive, and one of (a) or (i) occurs in the process.

24. A process of MICR and non-MICR electrostatic magnetic imaging of two independent electrostatic latent images comprising:

(a) optionally pre-treating a blank check with a wax based coating comprising an aqueous polyethylene wax emulsion, a surfactant and a viscosity modifier;

(b) forming a first electrostatic latent image in a MICR printing apparatus;

(c) developing the first electrostatic latent image by contacting the first electrostatic latent image with a MICR toner to produce a developed MICR toner image;

(d) transferring and optionally fusing the developed MICR toner image onto a check;

(e) forming a second electrostatic latent image in a non-MICR printing apparatus;

(f) developing the second electrostatic latent image by contacting the second electrostatic latent image with a non-MICR toner to produce a developed non-MICR image;

(g) transferring said developed non-MICR toner image to said check;

(h) fusing said developed MICR toner image and said developed non-MICR toner image to the check, wherein a fuser oil is supplied to the check during fusing;

(i) optionally coating the check having fused developed MICR toner image and fused developed non-MICR toner image with a wax-based coating comprising an aqueous polyethylene wax emulsion, and wherein (a) and (i) are mutually exclusive, and one of (a) or (i) occurs in the process.

* * * * *